US005865524A

United States Patent [19]

Campman

[11] Patent Number: 5,865,524

[45] Date of Patent: Feb. 2, 1999

[54] HAND HELD LIGHT WAND FOR VISUAL SIGNALING

[76] Inventor: James P. Campman, 329 Bendhill Rd., Fredonia, Pa. 16124

[21] Appl. No.: 857,169

[22] Filed: May 15, 1997

[51] Int. Cl.[6] ..... F21L 7/00

[52] U.S. Cl. ..... 362/102; 362/184; 362/205

[58] Field of Search ..... 362/102, 158, 362/184, 202, 205, 231, 800, 208

[56] References Cited

U.S. PATENT DOCUMENTS

| | | | |
|---|---|---|---|
| 2,816,277 | 12/1957 | Salkowski | 362/184 |
| 4,782,432 | 11/1988 | Coffman | 362/184 |
| 5,642,931 | 7/1997 | Gappelberg | 362/205 |

FOREIGN PATENT DOCUMENTS

| | | | |
|---|---|---|---|
| 671730 | 10/1963 | Canada | 362/102 |

*Primary Examiner*—Y My Quach

*Attorney, Agent, or Firm*—Daniel K. Dorsey

[57] ABSTRACT

A resilient watertight light baton is disclosed having multi-colored light source and power source mounted therein. The light sources are in electrical communication with the power source via magnetic switches and resistor elements. The exterior walls of the light baton are machined to effectively transmit light from the light source. The body of the light baton further includes a ring switch about a portion of the body proximate to the light source. The ring switch includes a magnetic portion. As the ring switch is rotated and the magnetic portion is brought proximate to the magnetic switches, the electrical communication is completed thereby activating the light source.

13 Claims, 2 Drawing Sheets

HAND HELD LIGHT WAND FOR VISUAL SIGNALING

BACKGROUND OF THE INVENTION

1. Field of the Invention

This invention relates to the field of communication and more particularly to an apparatus for hand held line of sight signaling.

2. Description of Related Art

Visual signaling is a common and easily understood method of relaying information from at least one person to another. Visual signaling is often used in environments hostile to other forms of communication. Such environments include traffic intersections, airports, mountain ranges, underwater and the like. Provided the environment is hospitable to the transmission of light from a source point to a receiver point, visual signaling provides an effective means of communication. However, such environments tend to be destructive on the visual signaling device.

One type of visual signaling device is a light baton or wand. Light batons are hand held devices which, at the control of the holder emit, colored and white light. Light batons are used to direct of pedestrians, motor vehicles, aviation vehicles, and the like. The baton may be used to generate light signals indicating safe and clear passage, dangerous and hazardous conditions, direction to proceed, or identifying one's location.

A common problem encountered in use of light batons is the shortened life span of the baton from usage in hostile and rugged environments. These environments expose the baton to manual battering as well as the natural elements. As a result, a need exists for a light baton having characteristics that can withstand use in hostile and rigid environments.

Several apparatuses and methods have been proposed. U.S. Pat. No. 5,105,309 to Baravaglio et al. discloses a signaling baton having a sealed cylindrical shape, made of synthetic materials, and including reflectors. U.S. Pat. No. 5,081,568 to Dong et al. discloses a light baton having LEDs, a second light source, a top and bottom cap, and electrical source and switches. U.S. Pat. No. 2,611,019 to Warner discloses a baton having machined surfaces intended to improve light transmission. U.S. Pat. No. 1,946,059 to Buchholz discloses a flashlight having different colored light sources within the flashlight body. U.S. Pat. No. 4,607,317 to Lin discloses a light baton including a pliable bulb holding bar for use in decorative advertising. U.S. Pat. No. 5,079,679 to Chin-Fa discloses a traffic directing light stick having a lamp element and a sound generating element. U.S. Pat. No. 4,782,432 to Coffman discloses a rechargeable portable illuminating device having elements for displaying a spotlight, a fluorescent light and strobe light.

While these various inventions in the prior art have provided improvements in visual signaling devices, none provides a visual signaling light emitting wand with a choice of different colors.

SUMMARY OF THE INVENTION

The hand held light wand of the present invention is a visual signaling light emitting wand that provides a user with a choice of different colors. This device is sealed at each end with hemisphere end caps. The present invention provides extreme robustness and is essentially a special case of an egg shape. This shape permits the light wand to withstand extreme depths of submergence, thus making it useful for deep diving signaling applications. The light wand of the present invention can easily change colors by simply turning the color select ring that also serves as an on/off switch.

Accordingly, it is an object of the present invention to provide an apparatus for the illumination of a visual signal.

It is another object of the present invention that the apparatus include a waterproof, robust, and translucent housing.

It is a further object of the present invention is that the apparatus be hand held and controlled with manual manipulation.

In order to achieve the above and related objects, the present invention comprises an apparatus for multi-colored visual signaling, wherein the apparatus is a waterproof, hand held, internally illuminating and powered light baton. The present baton also includes an external light selection and activation element. In addition, the present baton includes a body having a translucent surface for effective distribution and emission of light from the internal light source.

The baton body includes several portions that interconnect to form a watertight internal cavity. The several portions include a main housing, a forward cap and a rear cap. Housed within the internal cavity is a power source in electrical connection with an electrically powered lighting element. The lighting element includes a support for and electrical communication to a plurality of switches, resistors and light sources. The switches, resistors and light sources are all in electrical communication. The switches are manually controllable to selectively illuminate the light sources with power from the power source.

The above mentioned and other features and objects of the invention and the manner of attaining them will be best understood by reference to the following description of an embodiment of the invention, when considered in conjunction with the accompanying drawings:

BRIEF DESCRIPTION OF THE DRAWINGS

A preferred structural system embodiment and preferred subcomponents of this invention are disclosed in the accompanying drawings in which.

DETAILED DESCRIPTION OF THE DRAWINGS

Figure 1:
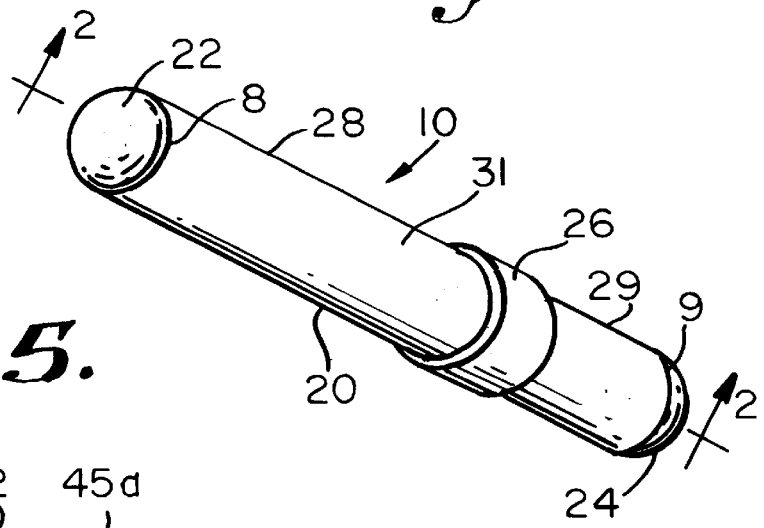
FIG. 1 is a perspective view of a first embodiment of the present invention.

FIG. 1 depicts a perspective view of a first embodiment of the present invention. As shown, the present invention comprises a light wand 10 having an elongated, hollow, tubular body 20. Body 20 includes a contiguous forward portion 28 and rear portion 29 separated by a switch housing 30.

A translucent front cap 22 is positioned at and contiguous with a forward distal end 8 of forward portion 28. A translucent back cap 24 is positioned at and contiguous with a rear distal end 9 of rear portion 29. Switching means 26 is accommodated within a switch housing.

The switch housing 30 and forward portion 28 have the same first internal diameter 4. The rear portion 29 has a second internal diameter 2 that is less than the first internal diameter 4.

Body 20 may be made of plastic, polyethylene or any resilient waterproof material. Forward portion 28 is translucent and may include light dispersing means 31 coated thereon. Light dispersing means 31 may include crushed prisms, knurled plastics, or any other light dispersing materials.

By way of an example, body 20 may be about twelve inches long, forward portion 28 may be about 7.71 inches long, switch housing may be about 1.04 inches long, and rear portion 29 may be about 3.25 inches long.

Figure 2:
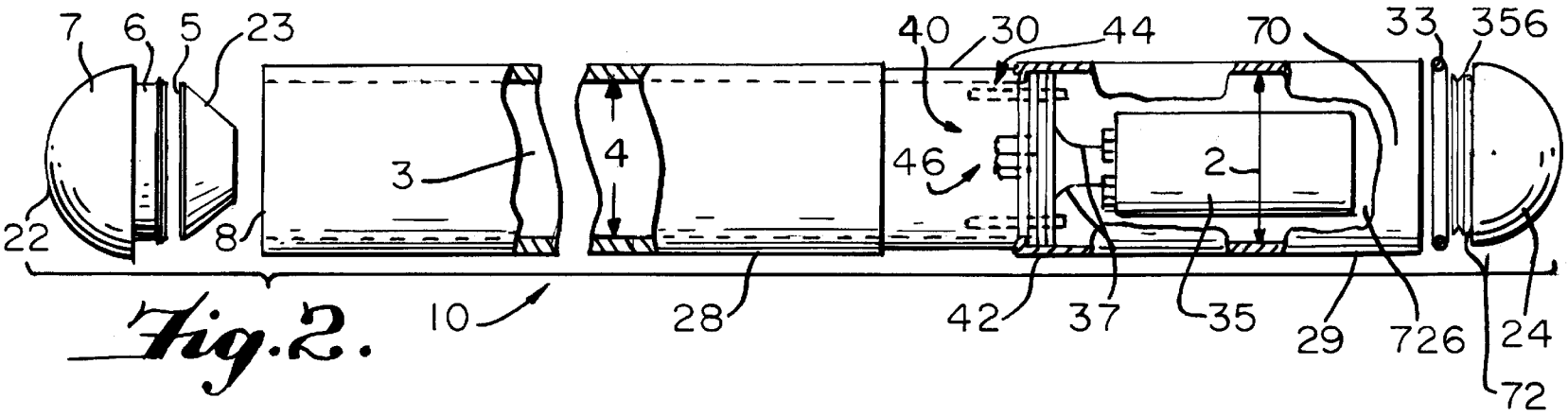
FIG. 2 is a partially exploded cross section along the line II—II of FIG. 1.

FIG. 2 depicts a partially exploded cross section along line II—II. The front cap 22 has translucent walls defining a forward hemispheric shape 7 and an elongated hollow tubular back portion 6. The tubular back portion is in optical communication with a translucent lens 23. In addition, the tubular back portion 6 has a diameter 5 approximately equal to the internal cavity diameter 4 of the forward portion 28. As a result, front cap 22 is held at the forward distal end 8 of the light baton 10 by friction fitting the tubular back portion 6 within the internal cavity 3 of the forward portion 28. By this arrangement, the front cap 22 remains in optical communication with the internal cavity 3 of forward portion 28. Front cap 22 may be composed of any suitable resilient water proof material such as plastic or glass.

The translucent lens 23 is attached to the tubular portion of front cap 22. The translucent lens 23 is held in place by the friction fit of the front cap 22 to the forward portion 28. The reflecting lens 23 directs light from within the forward portion 28 to the front cap 22 and beyond body 20. The translucent lens 23 may be of any shape and composition to facilitate light directing. The translucent lens 23 is affixed to front cap 22.

FIG. 2 depicts switch housing 30. As shown, switch housing 30 is a slot machined to have a diameter less than the diameter of body 20. Accommodated about the outside of the machined slot is switch means 26. Accommodated approximately below slot 30, within body 20, is lighting element 40.

Figure 5:
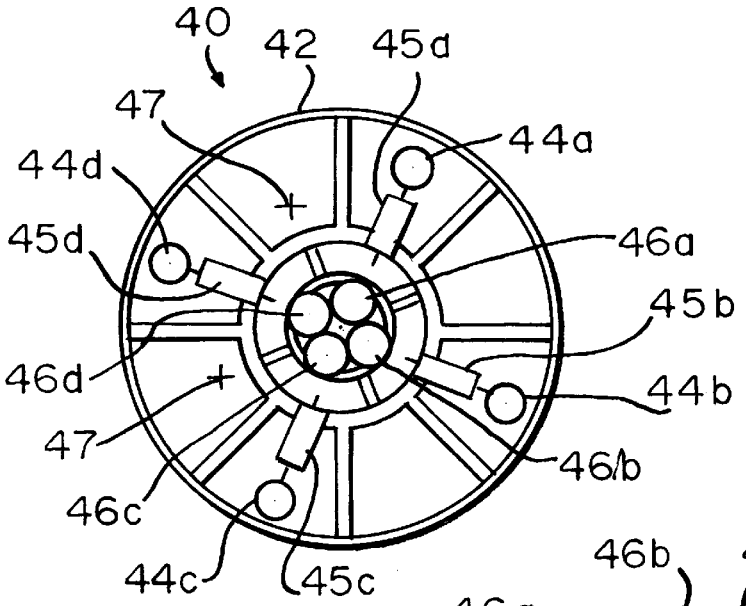
FIG. 5 is a top view of the light housing element depicted in FIG. 4.

FIG. 5 depicts lighting element 40 includes circuit card 42 accommodating thereon magnetic switches 44*a–d*, resistor means 45*a–d*, and light means 46*a–d* all in electrical communication. The circuit card 42 facilitates electrical communication between a power source 35 and the switches, resistors and light means.

The magnetic switches, resistors and light means are arranged in subcircuits on the circuit card 42. Each subcircuit is electrically connected and includes a single switch, a single resistor and a single light means. Each subcircuit is electrically isolated from the other subcircuits by the single switch. In operation, when a switch is closed, power is supplied to the light means associated with that switch. The light means is illuminated as a result of the flow of power thereto. The remaining switches may remain open, which means that the other light means are thereby isolating the associated light means and keeping same non-illuminating.

The circuit card 42 has a circular shape with approximately the same diameter as the internal diameter 2 of rear portion 29. Circuit card 42 is friction fit within rear portion 29 and pushed forward against the interior walls of the switch housing 30.

The magnetic switches may comprise Reed switches or any electrical switch that is activated by magnetic waves. The light means 46*a–d* may comprise light emitting diodes or any other resilient light source as known by the skilled artisan.

The rear distal end 70 of body 20 includes internal threads which communicate with threading 356 on a forward portion of back cap 24. The two threads communicate to secure the forward portion of end cap 24 within the internal cavity of rear portion 29. In addition, positioned about the forward portion 72 of back cap 24 is gasket 33. The gasket 33 is held in place by the securing action of end cap 24 and rear portion 29. The gasket 33 facilitates watertight communication between the end cap and the rear portion 29 of light wand 10.

Located within body 20, in the interior cavity 726 of rear portion 29, is power supply means 35. The power supply means 35 is in electrical communication 37 with the lighting element 40. Although depicted as a 9 volt battery, the power supply means 35 may be any electrical power source known by the skilled artisan that provides sufficient electrical operating power to lighting element 40.

Figure 3A:
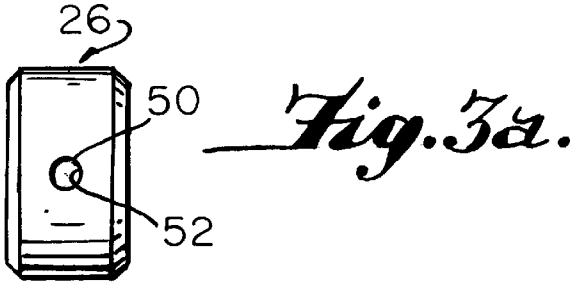
FIG. 3A is a front view of a switch ring depicted in FIG. 1.
Figure 3B:
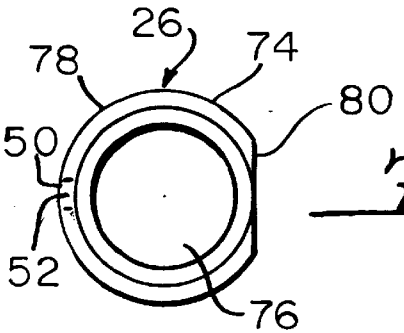
FIG. 3B is a side view of the switch ring of FIG. 3A.

FIG. 3A and 3B depict switching means 26. With general reference to these figures, switching means 26 has walls defining an elongated ringed body 74 with a hollow circular interior 76 and a beveled exterior surface 78. The ringed body 74 further includes a circular opening 50 there through. Accommodated within the circular opening 50 is magnetic material 52. The ringed body 74 also includes a flat surface 80 positioned on a side opposite to circular opening 50. The flat surface 80 is a break in the continuity of the circular ringed body 74 and facilitates temporary radial expansion of the ringed body during placement of same about switch housing 30. The flat surface also provides a supporting platform for preventing the baton from rolling away when placed on a flat surface.

By way of an example, the ring body has walls with a thickness of about 0.155 inches, a total diameter of about 1.79 inches, a length of about 1.00 inches and a beveled exterior of 0.84 inches in length.

Figure 4:
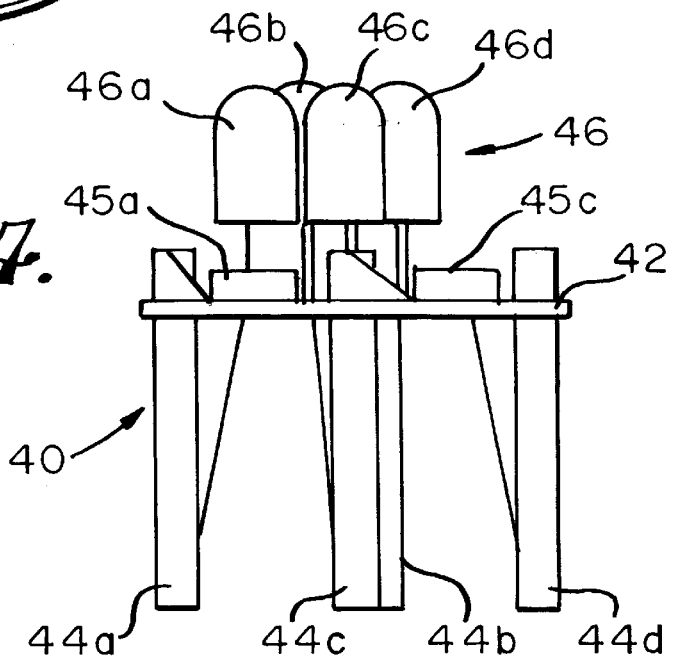
FIG. 4 is a perspective view of a light housing element of the first embodiment of the present invention.

FIGS. 4 and 5 depict lighting element 40. With general reference to these figures, lighting element 40 includes circuit card 42. Mounted on circuit card 42 is switch means 44*a–d* in electrical communication with light means 46*a–d* and resistor means 45*a–d*. Switch means are depicted herein extending below the circuit card 42. In addition, circuit card 42 includes connecting means 47 in electrical communication with a power source. Connecting means 47 receives power from the power source and facilitates delivery of same to the switching means, resistor means and light means.

The resistor means 45*a–d* may comprise any resistor composition which produces a resistance of approximately one hundred ohms. The light means 46*a–d* includes separate light sources for red light, green light, blue light and red flashing (or other color) light, (or any other color). The separate light sources are positioned at the proximate center of circuit card 42. The switch means are positioned about the perimeter of circuit card 42. Alternatively, in another embodiment, light means 46*a–d* may not include a flashing light source.

Figure 6:
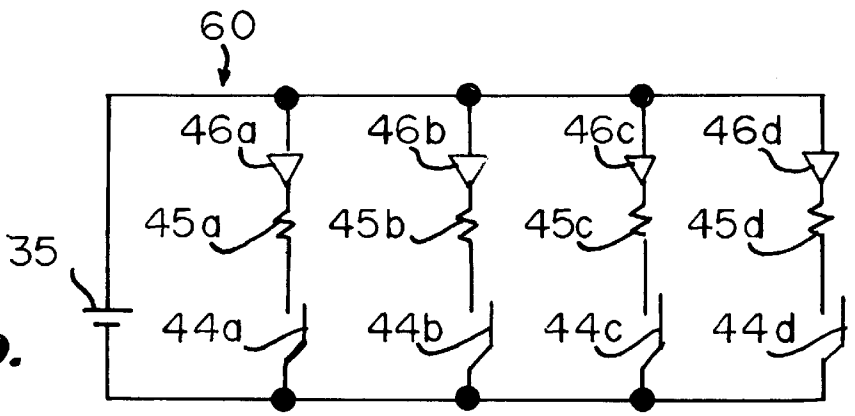
FIG. 6 is a schematic of the light housing element depicted in FIG. 4.

FIG. 6 depicts a schematic diagram of electric circuit 60 formed by the combination of power source 35, connecting means 47, magnetic switch means 44*a–d*, resistor means 45*a–d*, and light means 46*a–d*. Electric circuit 60 consists of four isolated subcircuits each having light means, resistor means, and switch means. When a switch means is closed, the associated subcircuit receives power and the power is directed to the light means. When the light means receives power, the light means illuminates. Each of the switch means 44*a–d* may be open or closed independent of the other. By the selective opening and closing of at least one of the switch means, the user can generate either light from a single activated light source or a selected combination of light from any number of the activated light sources.

The switch means comprise magnetic switches. The magnetic switches are activated by the presence and absence of magnetic energy. Switching means 26 includes the magnetic energy source 52 secured therein. When the magnetic energy source is brought proximate to a magnetic switch, the magnetic energy activates the magnetic switch causing same to close. The closed magnetic switch facilitates electrical communication to the associated subcircuit as described above.

The operation of the first embodiment of the present invention will now be described. Switching means 26 is rotatable about switch housing 30. The rotating of switching means 26 dislocates the magnetic means 52, housed within switching means 26, about the circumference of switch housing 30. When the magnetic means is brought proximate to magnetic switch means 44*a–d*, the magnetism of the magnetic means 52 activates or closes the magnetic switch. The closing of the magnetic switch closes the related subcircuit thereby providing current to the light means and activating the light means.

Continued rotation of the switching means dislocates the magnetic means from proximate the magnetic switch. The drop in magnetism produced by the removal of magnetic source, causes the magnetic switch to open thereby opening the related subcircuit and deactivating the light source. Continued rotation of the switching means brings the magnetic source once more proximate to a magnetic switch thereby facilitating activation of a second subcircuit. By continued rotation, the user is able to activate a desired light by closing the related subcircuit.

While a specific embodiment has been illustrated and described, numerous modifications are possible without departing from the spirit of the invention, and the scope of protection is only limited by the scope of the accompanying claims.

What is claimed is:

1. A hand held illuminating device for sight visual signaling, comprising:

a tubular body having a hollow interior and including a switch housing;

a lighting element, accommodated within said hollow interior of said tubular body and including at least one switch means and at least one light means in electrical communication with said switch means;

a power source positioned within said hollow interior of said tubular body, said power source in electrical communication with said lighting element for providing power to said lighting element;

a partial-circular ring shaped switching means including magnetic means and having an opening such that said magnetic means is accommodated within said opening, said switching means positioned about said switch housing to permit rotational displacement of said switching means around said switch housing for bringing said magnetic means proximate to said switch means thereby causing said switch means to close permitting power to flow from said power source to said light means causing said light means to emit light;

said tubular body further includes a contiguous forward portion and rearward portion, said forward portion including a forward distal opening communicating with said hollow interior of said tubular body, and said rearward portion includes a rear distal opening communicating with said hollow interior of said tubular body; and a front cap having surfaces defining a forward hemispheric shape and a rear hollow elongated tubular portion, a translucent lens having a conical shape, said tubular portion of said forward cap and translucent lens are accommodated within said forward distal opening of said front portion, said translucent lens cooperating with said front cap for directing some of said emitted light from within said hollow interior of said tubular body out said forward distal opening and said device further includes a rear cap having a forward hollow elongated tubular shape and a rear hemispheric shape, a gasket having an annular shape, said tubular slope of said rear cap and gasket are accommodated within said rear distal opening of said rearward portion.

2. A hand held illuminating device according to claim 1, wherein said forward portion of said tubular body is translucent and includes a transmissive coating.

3. A hand held illuminating device according to claim 2, wherein said transmissive coating is composed of a light dispersing material.

4. A hand held illuminating device according to claim 1, wherein said rear hollow elongated tubular portion of said front cap is sealed to said translucent lens so that said front cap is in watertight optical communication with said translucent lens and rear hollow elongated tubular portion of said front cap is sealed to said forward portion of said body, said rear cap and said gasket are sealed to said rearward portion and in watertight communication with said rear distal opening.

5. A hand held illuminating device according to claim 1, wherein said power source is housed within a cavity defined by said rearward portion, said lighting element is housed within said tubular body, and said switching means is accommodated about said switch housing such that rotational displacement of said switching means around said switch housing brings said magnetic means proximate to said switch means thereby switching said switch means to close an electric circuit between said power source and said light means causing said light means to emit light.

6. A hand held illuminating device according to claim 1, wherein said front cap is translucent.

7. A hand held illuminating device according to claim 1, wherein said front cap defining said rear hollow elongated tubular portion is translucent.

8. A hand held illuminating device according to claim 1, wherein said power source is a battery, said switch means are magnetic switch means, and resistor means have a resistance of at least 100 ohms, and said light means are light emitting diodes and selected from a group of, flashing red, green and blue light emitting diodes.

9. A hand held and manually operable illuminating device for sight visual signaling, comprising:

a body defining an elongated tubular shell with a hollow interior, said tubular shell further having a front portion, switch housing, and rear portion;

lighting element housed within said hollow interior of said elongated tubular shell, said lighting element including at least one magnetic switch means and at least one light means in electrical communication;

a power source accommodated within said hollow interior of said elongated tubular shell and in electrical communication with said lighting element for providing power to said lighting element switching means having a hollow partially circular ring shaped body, said partially circular ring shaped body having an opening through said partially circular ring shaped body, magnetic means housed within said opening, said switching means accommodated about said switch housing to permit rotational displacement of said magnetic means proximate to said magnetic switch means, whereby said magnetic means causes said at least one magnetic switch means to close thereby facilitating flow of power from said power source to said at least one light means causing said light means to illuminate and emit light;

a front cap having surfaces defining a forward hemispheric shape and a rear hollow elongated tubular shape, a translucent lens having walls defining a conical shape, said tubular shape of said front cap and translucent lens are accommodated within said front portion, said translucent lens cooperating with said front cap for directing said emitted light out from said hollow body.

10. A hand held and manually operable illuminating device according to claim 9, wherein said device further includes a rear cap having a forward hollow elongated tubular shape and a rear hemispheric shape, a gasket having an annular shape, said tubular shape of said rear cap and gasket are accommodated within said rear portion.

11. A hand held and manually operable illuminating device according to claim 10, wherein forward portion of said body said is translucent and includes a transmissive coating.

12. A hand held and manually operable illuminating device according to claim 10, wherein front cap further includes said rear hollow elongated tubular shape, said rear hollow elongated tubular shape is sealed to said translucent lens so that said front cap is in watertight optical communication with said translucent lens and rear hollow elongated tubular shape of said front cap is sealed to said body, said tubular shape of said rear cap and said gasket are in watertight communication with said rear portion.

13. A hand held and manually operable illuminating device according to claim 10, wherein said front cap having said forward hemispheric shape is translucent.

* * * * *